US006519317B2

(12) United States Patent
Richardson et al.

(10) Patent No.: US 6,519,317 B2
(45) Date of Patent: Feb. 11, 2003

(54) DUAL FLUID COOLING SYSTEM FOR HIGH POWER X-RAY TUBES

(75) Inventors: John E. Richardson, Salt Lake City, UT (US); Gregory C. Andrews, Sandy, UT (US); Robert S. Miller, Sandy, UT (US); Allen C. Campbell, Annabella, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/829,353

(22) Filed: Apr. 9, 2001

(65) Prior Publication Data

US 2002/0146092 A1 Oct. 10, 2002

(51) Int. Cl.[7] ..... H01J 35/10
(52) U.S. Cl. ..... 378/130; 378/200; 378/141
(58) Field of Search ..... 378/130, 131, 378/132, 143, 144, 199, 200, 141

(56) References Cited

U.S. PATENT DOCUMENTS

| | | | | | |
|---|---|---|---|---|---|
| 4,115,697 | A | | 9/1978 | Hounsfield et al. | 250/445 T |
| 4,405,876 | A | * | 9/1983 | Iversen | 313/30 |
| 4,622,687 | A | * | 11/1986 | Whitaker et al. | 378/130 |
| 4,709,559 | A | | 12/1987 | Dotzauer et al. | 62/499 |
| 4,866,743 | A | * | 9/1989 | Kroener | 378/4 |
| 5,018,181 | A | | 5/1991 | Iversen et al. | 378/144 |
| 5,541,975 | A | | 7/1996 | Anderson et al. | 378/130 |
| 5,610,968 | A | * | 3/1997 | Deucher et al. | 378/199 |
| 5,689,542 | A | | 11/1997 | Lavering et al. | 378/142 |
| 5,737,387 | A | * | 4/1998 | Smither | 378/130 |
| 5,875,227 | A | | 2/1999 | Bhatt | 378/132 |
| 6,002,745 | A | | 12/1999 | Miller et al. | 378/128 |
| 6,074,092 | A | | 6/2000 | Andrews | 378/200 |
| 6,084,942 | A | * | 7/2000 | Hell et al. | 378/200 |
| 6,115,454 | A | * | 9/2000 | Andrews et al. | 378/140 |
| 6,125,168 | A | | 9/2000 | Bhatt | 378/132 |
| 6,125,169 | A | | 9/2000 | Wandke et al. | 378/143 |
| 6,320,936 | B1 | * | 11/2001 | Holland, Sr. et al. | 378/140 |
| 6,438,208 | B1 | * | 8/2002 | Koller | 378/140 |
| 6,453,010 | B1 | * | 9/2002 | Miller et al. | 378/130 |

* cited by examiner

*Primary Examiner*—Drew A. Dunn
*Assistant Examiner*—Irakli Kiknadze
(74) *Attorney, Agent, or Firm*—Workman, Nydegger & Seeley

(57) ABSTRACT

A cooling system for use with high-power x-ray tubes. The cooling system includes a dielectric coolant disposed in the x-ray tube housing so as to absorb heat dissipated by the stator and other electrical components, as well as absorbing some heat from the x-ray tube itself. The cooling system also includes a coolant circuit employing a pressurized water/glycol solution as a coolant. Pressurization of the water/glycol solution is achieved by way of an accumulator which, by pressurizing the coolant to a desired level, raises its boiling point and capacity to absorb heat. A coolant pump circulates the pressurized coolant through a fluid passageway defined in an aperture of the x-ray tube and through a target cooling block disposed proximate to the x-ray tube in the x-ray tube housing, so as to position the coolant to absorb some of the heat generated at the aperture by secondary electrons, and the heat generated in the target cooling block by the target anode of the x-ray tube. The target cooling block is in contact with the dielectric fluid so that some of the heat absorbed by the dielectric coolant is transferred to the coolant flowing through the target cooling block. The heated coolant is then passed through an air/water radiator where a flow of air serves to remove some heat from the coolant. Thus cooled, the coolant then exits the radiator to repeat the cycle.

44 Claims, 9 Drawing Sheets

DUAL FLUID COOLING SYSTEM FOR HIGH POWER X-RAY TUBES

BACKGROUND OF THE INVENTION

1. The Field of the Invention

The present invention relates generally to x-ray tubes. More particularly, embodiments of the present invention relate to an x-ray tube cooling system that increases the rate of heat transfer from the x-ray tube so as to significantly improve tube performance and at the same time control stress and strain in the x-ray tube structures and thereby extend the operating life of the device.

2. The Relevant Technology

X-ray producing devices are extremely valuable tools that are used in a wide variety of applications, both industrial and medical. For example, such equipment is commonly used in areas such as diagnostic and therapeutic radiology; semiconductor manufacture and fabrication; and materials analysis and testing. While used in a number of different applications, the basic operation of x-ray tubes is similar. In general, x-rays, or x-ray radiation, are produced when electrons are accelerated, and then impinged upon a material of a particular composition.

Typically, this process is carried out within a vacuum enclosure. Disposed within the evacuated enclosure is an electron generator, or cathode, and a target anode, which is spaced apart from the cathode. In operation, electrical power is applied to a filament portion of the cathode, which causes electrons to be emitted. A high voltage potential is then placed between the anode and the cathode, which causes the emitted electrons accelerate towards a target surface positioned on the anode. Typically, the electrons are "focused" into an electron beam towards a desired "focal spot" located at the target surface.

During operation of an x-ray tube, the electrons in the beam strike the target surface (or focal track) at a high velocity. The target surface on the target anode is composed of a material having a high atomic number, and a portion of the kinetic energy of the striking electron stream is thus converted to electromagnetic waves of very high frequency, i.e., x-rays. The resulting x-rays emanate from the target surface, and are then collimated through a window formed in the x-ray tube for penetration into an object, such as a patient's body. As is well known, the x-rays can be used for therapeutic treatment, or for x-ray medical diagnostic examination or material analysis procedures.

In addition to stimulating the production of x-rays, the kinetic energy of the striking electron stream also causes a significant amount of heat to be produced in the target anode. As a result, the target anode typically experiences extremely high operating temperatures. At least some of the heat generated in the target anode is absorbed by other structures and components of the x-ray device as well.

A percentage of the electrons that strike the target surface rebound from the surface and then impact other "non-target" surfaces within the x-ray tube evacuated enclosure. These are often referred to as "secondary" electrons. These secondary electrons retain a significant amount of kinetic energy after rebounding, and when they impact these other non-target surfaces, a significant amount of heat is generated. This heat can ultimately damage the x-ray tube, and shorten its operational life. In particular, the heat produced by secondary electrons, in conjunction with the high temperatures present at the target anode, often reaches levels high enough to damage portions of the x-ray tube structure. For example, the joints and connection points between x-ray tube structures can be weakened when repeatedly subjected to such thermal stresses. Such conditions can shorten the operating life of the tube, affect its operating efficiency, and/or render it inoperable.

The consequences of high operating temperatures and inadequate heat removal in x-ray tubes are not limited solely to destructive structural effects however. For example, even in relatively low-powered x-ray tubes, the window area can become sufficiently hot to boil coolant that is adjacent to the window. The bubbles produced by such boiling may obscure the window of the x-ray tube and thereby compromise the quality of the images produced by the x-ray device. Further, boiling of the coolant can result in the chemical breakdown of the coolant, thereby rendering it ineffective, and necessitating its removal and replacement. Also, the window structure itself can be damaged from the excessive heat; for instance, the weld between the window structure and the evacuated housing can fail.

While the aforementioned problems are cause for concern in all x-ray tubes, these problems become particularly acute in the new generation of high-power x-ray tubes which have relatively higher operating temperatures than the typical devices. In general, high-powered x-ray devices have operating powers that exceed 40 kilowatts (kw).

Attempts have been made to reduce temperatures in x-ray tubes, and thereby minimize thermal stress and strain, through the use of various types of cooling systems. However, previously available x-ray tube cooling systems and cooling media have not been entirely satisfactory in providing effective and efficient cooling. Moreover, the inadequacies of known x-ray tube cooling systems and cooling media are further exacerbated by the increased heat levels that are characteristic of high-powered x-ray tubes.

For example, conventional x-ray tube systems often utilize some type of liquid cooling arrangement. In many of such systems, a volume of a coolant is contained inside the x-ray tube housing so as to facilitate natural convective cooling of x-ray tube components disposed therein, and particularly components that are in relatively close proximity to the target anode. Heat absorbed by the coolant from the x-ray tube components is then conducted out through the walls of the x-ray tube housing and dissipated on the surface of the x-ray tube housing. However, while these types of systems and processes are adequate to cool some relatively low powered x-ray tubes, they may not be adequate to effectively counteract the extremely high heat levels typically produced in high-power x-ray tubes.

As suggested above, the ability of conventional cooling systems to absorb heat from the x-ray device is primarily a function of the type of coolant employed, and the surface area of the x-ray tube housing. Most conventional systems have focused on the use of various coolants to effect the required heat transfer.

Coolants typically employed in conventional cooling systems include dielectric, or electrically non-conductive, fluids such as dielectric oils or the like. One important function of these coolants is to absorb heat from electrical and electronic components, such as the stator, disposed inside the x-ray tube housing. In order to effect heat removal from these components, the coolant is typically placed in direct contact with them. If the coolant were electrically conductive, rather than dielectric, the coolant would quickly short out or otherwise damage the electrical components, thereby rendering the x-ray tube inoperable. Thus, the dielectric feature of the coolants typically employed in conventional x-ray tube cooling systems is critical to the safe and effective operation of the x-ray tube.

While dielectric type coolants thus possess some properties that render them particularly desirable for use in x-ray tube cooling systems, the capacity of such coolants to remove heat from the x-ray tube is inherently limited. As is well known, the capacity of a cooling medium to store thermal energy, or heat, is often expressed in terms of the specific heat of that medium. The specific heat of a given cooling medium is at least partially a function of the chemical properties of that cooling medium. The higher the specific heat of a medium, the greater the ability of that medium to absorb heat.

Thus, the relatively low specific heat (c), typically in the range of about 0.4 to about 0.5 BTU/lb. ° F., of the cooling media employed in conventional x-ray tube cooling systems have a significant limiting effect on the ability of those media to effect the heat transfer rates that are necessary to ensure the efficient operation and long life of x-ray tubes, and particularly, high-power x-ray tubes. As previously discussed, there are a variety of undesirable consequences when the x-ray tube produces more heat than the coolant can effectively absorb.

The inability of dielectric oils or the like to effect the rates of heat transfer necessary to ensure the efficient operation and long life of x-ray tubes, and particularly, high-power x-ray tubes, is further aggravated by the relatively inefficient manner in which those coolants are employed. In particular, the volume of coolant contained inside the x-ray tube housing is relatively stagnant, and does not circulate throughout the housing. Thus, the cooling effect provided by the coolant is limited primarily to natural convection, a relatively inefficient cooling process, and one that is particularly unsuited to meet the demands of high-power x-ray devices.

Another problem with conventional x-ray tube cooling systems such as those discussed herein concerns the limited volume of coolant available for cooling. A lower volume of fluid affects the heat capacity of the cooling system. Thus, the limited capacity of the coolant employed in conventional x-ray tube cooling systems to absorb heat may limit the system's efficiency.

In view of the foregoing problems and shortcomings with existing x-ray tube cooling systems, it would be an advancement in the art to provide a cooling system that effectively removes heat from the x-ray tube at a higher rate than is otherwise possible with conventional cooling systems and cooling media. Further, the cooling system should effect sufficient heat removal so as to reduce the amount of thermally-induced mechanical stresses and strain otherwise present within the x-ray tube, and thereby increase the overall operating life of the x-ray tube. Likewise, the cooling system should substantially prevent heat-related damage from occurring in the materials used to fabricate the vacuum enclosure, and should reduce structural damage occurring at joints between the various structural components of the x-ray tube.

SUMMARY OF PRESENTLY PREFERRED EMBODIMENTS OF THE INVENTION

The present invention has been developed in response to the current state of the art, and in particular, in response to these and other problems and needs that have not been fully or adequately solved by currently available x-ray tube cooling systems. In general, presently preferred embodiments of the present invention provide an x-ray tube cooling system that effectively and efficiently removes heat from x-ray tube components at a higher rate than is otherwise possible with conventional x-ray tube cooling systems and cooling media. Preferably, embodiments of the x-ray tube cooling system remove sufficient heat from the x-ray tube so as to reduce the occurrence of thermally induced stresses and strain that could otherwise reduce the x-ray tube's operating efficiency, limit its operating life, and/or render the tube inoperable. Embodiments of the present invention are particularly suitable for use with high-powered x-ray tubes employing a grounded anode configuration.

In a preferred embodiment, the x-ray tube cooling system incorporates a dual coolant configuration. A volume of a first coolant, preferably a dielectric oil or the like, is confined inside the x-ray tube housing in a manner so as to absorb heat from the stator and other components disposed in the housing. Preferably, a pump or the like is employed to circulate the first coolant inside the housing so as to enhance the efficiency of heat absorption by the first coolant. In one alternative embodiment, the first coolant is routed to a heat exchange mechanism, such as a radiator or the like.

Another portion of the dual coolant configuration is a closed coolant circuit that includes a shield structure and a target cooling block, each of which include fluid passageways that are in fluid communication with a coolant pump and radiator, or similar heat exchange mechanism. Preferably, the target cooling block is disposed substantially proximate to the target anode so as to absorb at least some heat therefrom. In a preferred embodiment, at least a portion of the target cooling block is also in contact with the first coolant. Also, in preferred embodiments, the dual coolant configuration includes an accumulator for maintaining a desired level of pressure in the system, and for accommodating volumetric changes in a second coolant due to thermally induced expansion.

In operation, the second coolant, preferably a propylene glycol and water solution or the like, is passed through the radiator by the coolant pump so that heat is removed from the second coolant. Thus cooled, the second coolant then exits the heat exchanger and passes into the fluid passageway of the x-ray tube shield structure, absorbing heat generated in the shield structure by the impact of secondary electrons. After passing through the fluid passageway of the shield structure, the second coolant then enters the fluid passageway defined in the target cooling block and absorbs a portion of the heat dissipated by the first coolant. The second coolant also absorbs heat transmitted to the target cooling block by the target anode. After exiting the fluid passageway of the target cooling block, the second coolant then returns to the coolant pump to repeat the cycle.

The second coolant also serves to remove heat from the first coolant that is disposed within the x-ray tube housing. To maximize this heat transfer, preferred embodiments include means for transferring at least a portion of the heat in the first coolant to the second coolant. This function can be provided by way of a number of different types of heat transfer mechanisms, such as fins, heat sinks, heat pipes, fluid-to-fluid heat exchange devices, and the like.

As the second coolant circulates and absorbs heat from the x-ray tube structures and the first coolant, the temperature of the second coolant, and thus its volume, increases. The accumulator provides a space which serves to accommodate the increase in second coolant volume due to increased temperature. As a result of the increase in second coolant volume, the system pressure increases. The accumulator permits the pressure in the second coolant system to reach a predetermined point, and then maintains the pressure of the second coolant at that point. By maintaining the pressure of the second coolant at a desired level, the accumulator thereby serves to facilitate a relative increase in the boiling point, and thus the heat absorption capacity, of the second coolant.

BRIEF DESCRIPTION OF THE DRAWINGS

In order to more fully understand the manner in which the above recited and other advantages and objects of the invention are obtained, a more particular description of the invention will be rendered by reference to specific embodiments thereof which are illustrated in the appended drawings. It will be appreciated that the drawings are not necessarily drawn to scale, and that they are intended to depict only the presently preferred and best mode embodiments of the invention, and are not to be considered to be limiting of the scope of the invention.

DETAILED DESCRIPTION OF THE PREFERRED EMBODIMENTS

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

In general, the present invention relates to cooling systems for use in cooling high-powered x-ray tubes, although it will be appreciated that the present invention could find application in any type of x-ray tube environment requiring improved cooling. FIGS. 1 through 5C indicate various embodiments of a cooling system conforming to the teachings of the invention.

Figure 1:
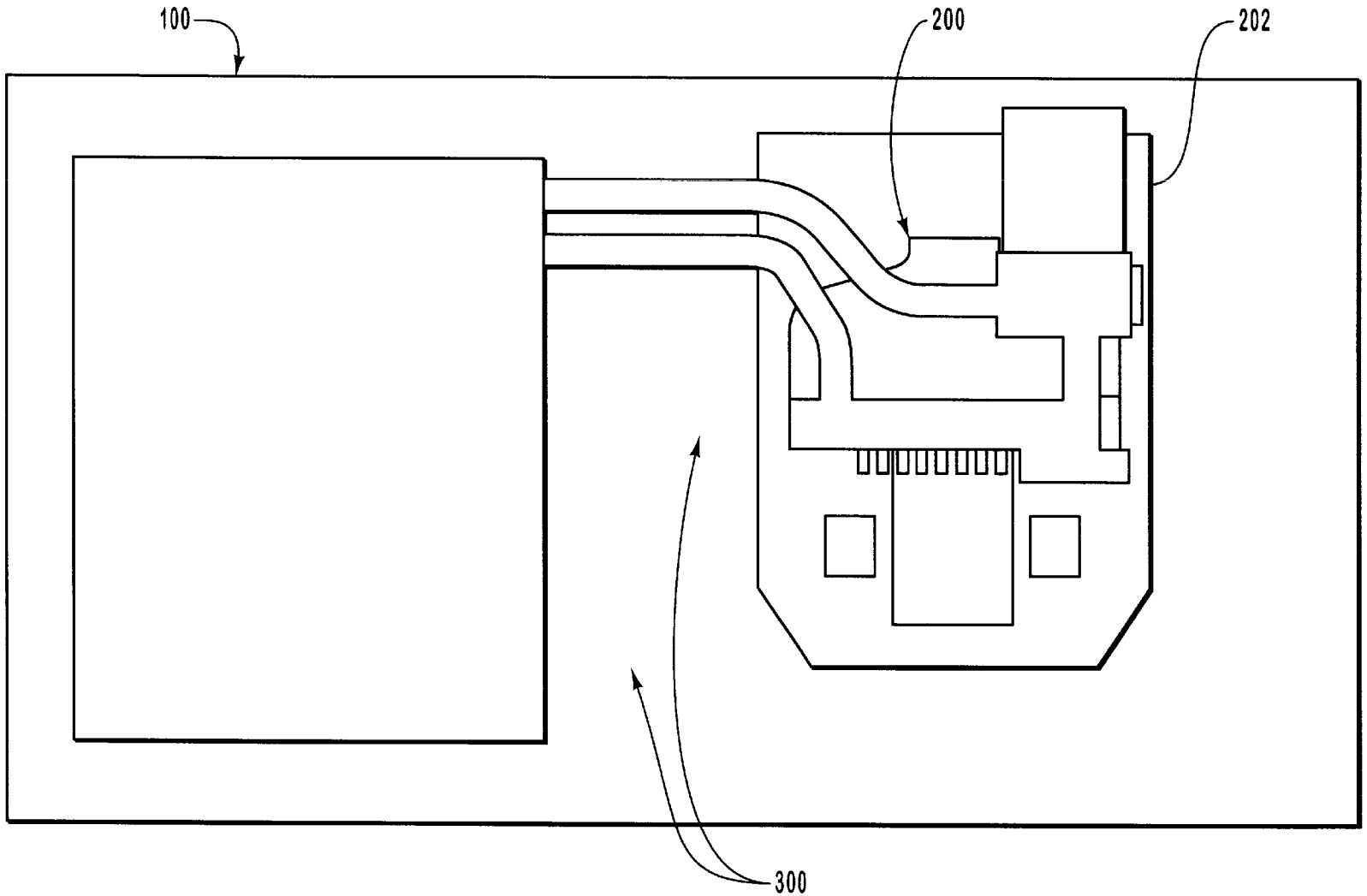
FIG. 1 is a simplified diagram depicting the interrelationship of various elements of an embodiment of the present invention.

Reference is first made to FIG. 1, wherein an x-ray device is designated generally at 100. X-ray device 100 includes an x-ray tube 200 substantially disposed in a housing 202, and a cooling system, indicated generally at 300. In general, cooling system 300 serves to remove heat from x-ray tube 200 of x-ray device 100.

As suggested in FIG. 1 and discussed in greater detail below, cooling system 300 may interface with x-ray tube 200 in various ways so as to produce a variety of different cooling system configurations. For example, some components of x-ray tube 200 also comprise flow passages through which a coolant of cooling system 300 is passed so as to absorb heat dissipated by those components. Components of this type are functional elements of x-ray tube 200, that is, they perform a function directly necessary to the operation of x-ray tube 200, but also serve to facilitate cooling of x-ray tube 200. Other components are not functional elements of x-ray tube 200, and are dedicated solely to effectuate a cooling function. In still other cases, portions of x-ray tube 200 are simply immersed in a coolant so that the coolant absorbs at least some of the heat dissipated by the component. The present invention accordingly contemplates as within its scope a wide variety of cooling configurations including, but not limited to, the aforementioned examples and combinations thereof.

Figure 2:
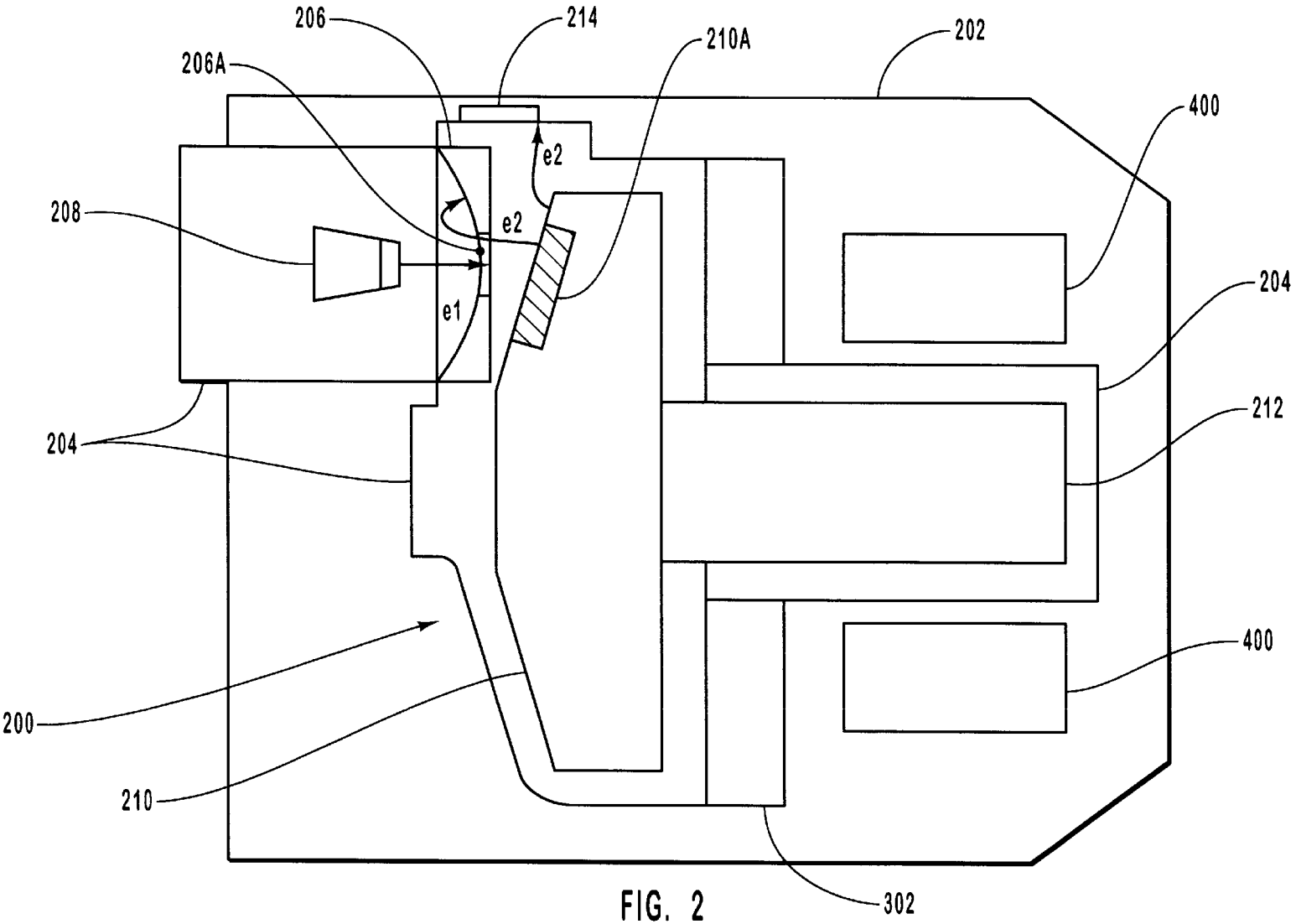
FIG. 2 is a cutaway view of an embodiment of an x-ray tube, depicting some of the fundamental elements of the x-ray tube, and indicating typical travel paths of secondary electrons.

Directing attention now to FIG. 2, x-ray tube 200 includes an evacuated enclosure 204. Disposed inside evacuated enclosure 204 on opposite sides of a shield structure 206 are an electron source 208 and a target anode 210. While any appropriate shield structure could be used, one example of a preferred embodiment of a shield structure 206 is described and claimed in co-pending U.S. patent application Ser. No. 09/351,579, filed on Jul. 12, 1999 and entitled "COOLING SYSTEM FOR X-RAY TUBE (wherein the assignee thereof is Varian Medical Corporation). The disclosure of the aforementioned application is accordingly incorporated by reference herein. As further indicated in FIG. 2, target anode 210 is secured to rotor 212. High speed rotation is imparted to target anode 210 by a stator 400 substantially disposed around rotor 212. Finally, a target cooling block 302, discussed in detail below, is disposed substantially proximate to target anode 210.

In operation, power is applied to electron source 208, which causes a beam of electrons to be emitted by thermionic emission. A potential difference is applied between the electron source 208 and target anode 210, which causes the electrons e1 to accelerate through an aperture 206A defined in shield structure 206 and impinge upon a focal spot 210A location on the target anode 210. A portion of the resulting kinetic energy is released as x-rays (not shown), which are then collimated and emitted through window 214 and into, for example, the body of a patient. Much of the kinetic energy of the electrons, however, is converted to heat. The heat thus produced is significant and causes extremely high operating temperatures in the target anode 210 and in other structures and components of x-ray tube 200.

As suggested in FIG. 2 however, some of the electrons striking target anode 210 rebound from the target anode 210, and then strike other "non-target" areas, such as the window 214, and/or other areas within the evacuated enclosure 204. As discussed elsewhere herein, the kinetic energy of these secondary electron e2 collisions also generates extremely high temperatures. As with the heat generated at target anode 210, it is essential to the long life and reliability of the x-ray device that the heat generated by the impact of secondary electrons e2 be reliably and continuously removed.

Figure 3:
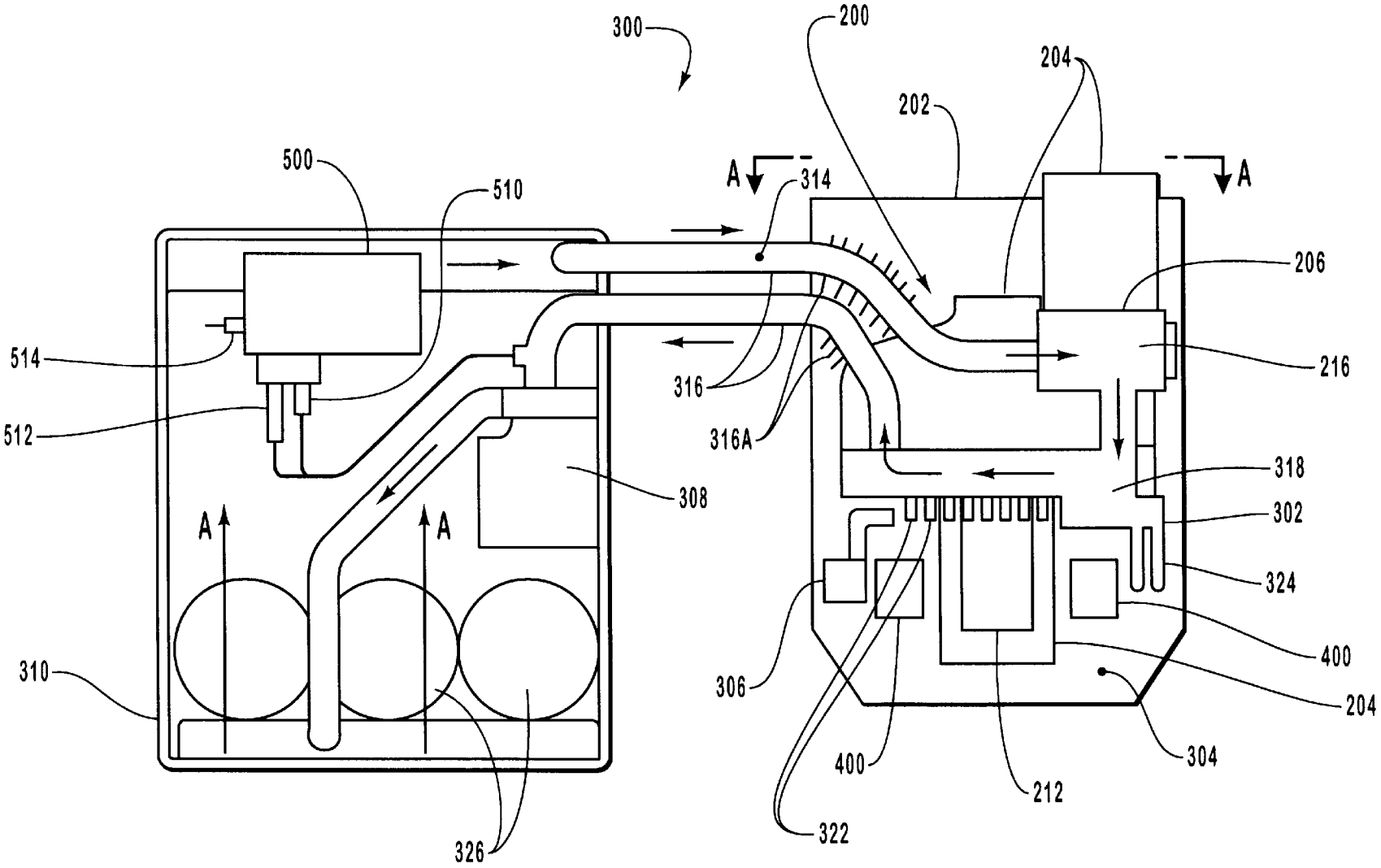
FIG. 3 is a schematic of an embodiment of a dual fluid cooling system, indicating various components of the system and their relationship to each other.

Directing attention now to FIG. 3, an embodiment of cooling system 300 is indicated. Although previously discussed in the context of x-ray tube 200, some elements depicted in FIG. 3, shield structure 206 for example, also comprise features used in the operation of cooling system 300. For the purposes of the present discussion then, those elements will be discussed primarily in terms of their role in the operation of cooling system 300.

In general, a presently preferred embodiment of cooling system 300 comprises at least two different aspects, or elements. One element of cooling system 300 is primarily concerned with removing heat from electrical and electronic components disposed within housing 202. A second element of cooling system 300 is concerned, generally, with removing heat from various other structures and components of x-ray tube 200. In a preferred embodiment, the elements of cooling system 300 interface with each other so as to desirably facilitate at least some heat transfer from one element to another. One embodiment of structure that is well-adapted to facilitate such an interface is target cooling block 302, the operational and structural details of which are discussed below. Finally, cooling system 300 preferably comprises instrumentation for monitoring the performance, and various parameters of interest such as pressure and temperature, of cooling system 300. Instrumentation contemplated as being within the scope of the present invention includes, but is not limited to, pressure gauges, temperature gauges, flow meters, flow switches, and the like.

As noted above, one element of cooling system 300 is concerned primarily with cooling electrical and electronic components inside housing 202. In a preferred embodiment, this is provided via a volume of a first coolant 304 that is confined within housing 202 so as to come into substantial contact with x-ray tube 200 and thereby absorb heat dissipated by x-ray tube 200. In one preferred embodiment, at least a portion of the heat absorbed by first coolant 304 is transmitted to housing 202, which then conducts and dissipates the heat to the atmosphere.

Preferably, housing 202 is substantially filled with first coolant 304 so that the coolant is in direct and substantial contact with exposed surfaces of the x-ray tube 200, as well as with other related electrical and/or electronic components disposed in housing 202. This direct and substantial contact serves to facilitate a high level of convective heat transfer from the components to the coolant. Electrical and electronic components contemplated as being cooled by embodiments of the present invention include, but are not limited to, stator 400. In an alternative embodiment, a dedicated stator housing disposed around stator 400 is provided which is substantially filled with first coolant 304. However, the present invention contemplates as within its scope any other arrangement and/or structure(s) which would provide the functionality of housing 202 and first coolant 304, with respect to stator 400, as disclosed herein.

In a preferred embodiment, first coolant 304 is a non-conductive liquid coolant such as a dielectric oil or the like, so as to substantially prevent shorting out of electrical components, such as stator 400, disposed in housing 202. As contemplated herein, 'non-conductive' refers to materials characterized by a level of electrical conductivity that would not materially impair the operation of stator 400 and/or other electrical and/or electronic components disposed in housing 202. Examples of coolants providing such functionality include, but are not limited to, Shell Diala Oil AX, or Syltherm 800. However, any other coolant providing the functionality of first coolant 304, as disclosed herein, is contemplated as being within the scope of the present invention. Such coolants include, but are not limited to, gases. One example of a coolant gas contemplated as being within the scope of the present invention is atmospheric air. Preferably, the gas employed as a coolant has a relatively low dew point, so as to substantially foreclose moisture-related damage to electrical and/or electronic components disposed in housing 202.

With continuing reference now to FIG. 3, a preferred embodiment of cooling system 300 includes circulating pump 306. In operation, circulating pump 306 serves to circulate first coolant 304 throughout housing 202. By inducing motion in first coolant 304, circulating pump 306 introduces a forced convection cooling effect that desirably augments the convective cooling effect provided by virtue of the substantial contact between first coolant 304 and electrical components, such as stator 400, and x-ray tube 200 disposed in housing 202. Circulating pump 306 thus serves to increase the efficiency of heat absorption by first coolant 304 to a level higher than would otherwise be possible. In an alternative embodiment, first coolant 304 is a gas, such as atmospheric air, and is circulated throughout housing 202 by a fan, or the like.

As previously noted, cooling system 300 also includes an element that is concerned with, among other things, cooling various structures of x-ray tube 200. With continuing reference now to FIG. 3, one presently preferred embodiment of cooling system 300 further comprises a second coolant, a coolant pump 308, a heat exchange means such as a radiator 310, and a means for regulating pressure, such as an accumulator 500.

In general, coolant pump 308 circulates a second coolant 314 through one or more fluid passageways proximate to x-ray tube 200 so that second coolant 314 absorbs at least some of the heat dissipated by x-ray tube 200. Preferably, the second coolant is also circulated in a manner so as to remove heat from the first coolant. The portion of coolant system 300 through which second coolant 314 passes is preferably closed so as to facilitate continuous circulation of second coolant 314. Note that in an alternative embodiment, a plurality of coolant pumps 308 are employed to circulate second coolant 314. After absorbing heat dissipated by x-ray tube 200, the heated second coolant 314 is then passed through a heat exchange means, such as radiator 310, so that at least some heat is removed from second coolant 314.

Preferably, second coolant 314 is a solution of about 50% propylene glycol and about 50% deionized water. It will be appreciated however, that the relative proportions of deionized water and the propylene glycol in second coolant 314 may be varied as required to achieve a desired cooling effect. As an alternative to propylene glycol, other alcohols such as ethylene glycol could profitably be substituted. The inclusion of various types of alcohols, or the like, in the deionized water has the desirable effects, discussed in further detail elsewhere herein, of lowering the freezing point and raising the boiling point of second coolant 314, relative to the freezing point and boiling point, respectively, of substantially pure deionized water. While some embodiments of second coolant 314 comprise a deionized water/alcohol solution, the present invention contemplates as within its scope any liquid coolant providing the functionality of second coolant 314 as disclosed herein.

When thus employed, second coolant 314 serves both to desirably augment the heat absorption capacity of first coolant 304, and also significantly increase the overall rate of heat transfer from x-ray tube 200. The dual coolant feature thus renders cooling system 300 particularly well-suited for use in effectively counteracting the extremely high heat levels typically produced in high-power x-ray tubes. Cooling system 300, as disclosed herein, accordingly represents an advancement in the relevant art.

Figure 4:
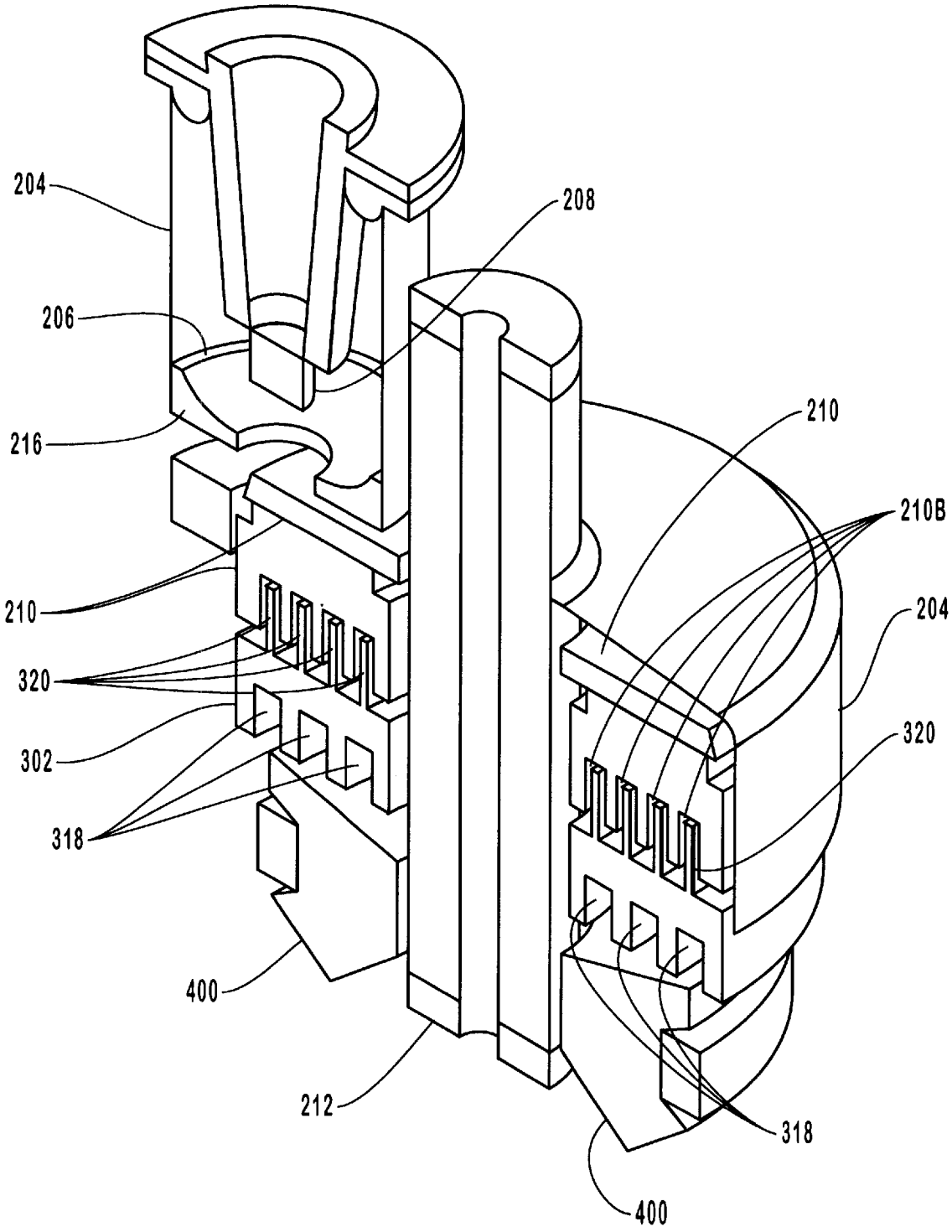
FIG. 4 is a perspective section view taken along line A—A of FIG. 3, and indicating additional details of the shield structure and target cooling block.

With continuing reference now to FIG. 3, and directing attention to FIG. 4, second coolant 314 exits radiator 310 and then passes through fluid conduit 316, preferably a hose or the like, and enters and passes through first fluid passageway 216 defined in shield structure 206 so as to absorb at least some of the heat dissipated thereby. In one preferred embodiment, means for enhancing the transfer of heat to the second coolant is provided, such as a plurality of fins 316A, or the like, disposed on the outer surface of the fluid conduit 316. Other structures that increase the external surface area of fluid conduit 316 so as to facilitate improved heat transfer to the second coolant 314 as it passes through fluid conduits 316 could also be used. Such structures include, but are not limited to, fins internal to conduit 316, or a combination of internal and external fins. Also, while fins 316A are illustrated as being disposed along a particular portion of the fluid conduit 316, it will be appreciated that the fins 316A could be positioned along different points so as to obtain different cooling dynamics.

As suggested above, second coolant 314 functions to, among other things, absorb at least some of the heat dissipated in shield structure 206 as a result of secondary electron bombardment. As previously noted, various embodiments of shield structure 206 are described and claimed in co-pending U.S. patent application Ser. No. 09/351,579. However, the present invention contemplates as within its scope any other structure providing the functionality of shield structure 206, as disclosed herein and/or in the aforementioned co-pending patent application.

In a preferred embodiment, fluid passageway 216 of shield structure 206 is in fluid communication with a fluid passageway 318 defined in target cooling block 302, so that upon exiting first fluid passageway 216, second coolant 314 is thereupon directed to one or more locations where it is able to absorb heat generated by target anode 210 and subsequently dissipated by target cooling block 302. In an alternative embodiment, fluid passageway 216 and fluid passageway 318 are connected to each other by a fluid conduit comprising surface area augmentation, such as cooling fins or the like. The fluid conduit and cooling fins cooperate to dissipate heat absorbed from shield structure 206 by second coolant 314.

It will be appreciated that the number of fluid passageways 218 defined in target cooling block 302 may be varied to achieve one or more specific desired cooling effects. Further, it is not necessary that fluid passageway 216 and fluid passageway 218 be in fluid communication with each other, each fluid passageway could profitably be served by a corresponding dedicated flow of second coolant 314. Likewise, it is not necessary that second coolant 314 pass first through fluid passageway 216 and then through fluid passageway 218, in fact, the order could be reversed. Alternatively, an arrangement is contemplated wherein second coolant 314 enters fluid passageway 216 and fluid passageway 218 at substantially the same time. In view of the foregoing, it will thus be appreciated that the path, or paths, taken by second coolant 314 may be varied as required to achieve one or more desired cooling effects. Likewise, the volume of second coolant 314 disposed in cooling system 300 may be varied as required.

Preferably, target cooling block 302 comprises a heat transfer mechanism in the form of a plurality of outward extending fins 320, as indicated in FIG. 4. At least a portion of each fin 320 fits within a corresponding slot 210B defined by target anode 210. In a preferred embodiment, target cooling block 302 is disposed in substantial proximity to target anode 210 so as to effectuate effective and efficient heat transfer from target anode 210 to fins 320 of target cooling block 302, and thence to second coolant 314.

Note that target cooling block 302 is simply one embodiment of a structure adapted to facilitate effective and efficient absorption of heat dissipated by target anode 210. The present invention contemplates as within its scope any other structure providing the functionality of target cooling block 302, as disclosed herein.

Directing continued attention to FIG. 3, a preferred embodiment of target cooling block 302 further comprises another form of heat transfer mechanism, also in the form of a plurality of fins 322 that are oriented so as to be in direct contact with at least a portion of the first coolant 304. In this embodiment, circulating pump 306 is oriented within housing 202 so that it directs the flow of first coolant 304 directly across the fins 322 of the target cooling block 302. When positioned in this manner, the circulating pump 306 provides a forced convection cooling effect by causing the first coolant 304 to flow across the fins 322. Fins 322 thus facilitate an increased rate of heat transfer from first coolant 304 to target cooling block 302, and thence to second coolant 314 passing therethrough. By absorbing at least some heat dissipated by first coolant 304, second coolant 314 serves to effectuate a relative increase in the heat absorption capacity of first coolant 304.

Another desirable consequence of the aforementioned configuration is that second coolant 314 also serves to remove heat dissipated to first coolant 304 that cannot be readily dissipated through the surface of housing 202 when first coolant 304 reaches an equilibrium temperature. Second coolant 314 thus serves to substantially reduce the likelihood of the boiling and/or thermal breakdown of first coolant 304 that often result when first coolant 304 is overheated, and thereby contributes to the increased life of first coolant 304, and of x-ray device 100 as a whole.

While the embodiment depicted in FIG. 3 discloses a configuration wherein at least a portion of target cooling block 302 is in contact with first coolant 304, it will be appreciated that a variety of other configurations and/or embodiments of target cooling block 302 will provide the functionality disclosed herein. Such configurations and/or embodiments contemplated as being within the scope of the present invention include, but are not limited to, an embodiment of a target cooling block comprising a second fluid passageway through which first coolant 304 is passed so as to dissipate heat to second coolant 314 passing through fluid passageway 318.

In another alternative embodiment, target cooling block 302 includes means for transferring at least a portion of the heat in the first coolant 304 to the second coolant 314. By way of example, the heat transfer means can be comprised of a heat transfer mechanism in the form of plurality of heat pipes 324 having an internal passageway or passageways that are in fluid communication with fluid passageway 318. The heat pipes 324 extend outwardly into a portion of the first coolant 304 so that second coolant 314 circulating through heat pipes 324 absorbs at least some of the heat dissipated by first coolant 304. In preferred embodiments, the surface area of heat pipes 324 can be augmented with structure including, but not limited to, fins or the like so as to provide a relative increase in the rate of heat transfer from first coolant 304 to second coolant 314. It will be appreciated that the surface area of the heat pipes 324 may be augmented in a variety of other ways as well, including but not limited to, disposing a plurality of fins upon the internal surfaces of heat pipes 324. Accordingly, any augmentation of the surface area of heat pipes 324 so as to facilitate achievement of a desired cooling effect is contemplated as being within the scope of the present invention. Also, it will be appreciated that the circulation of first coolant 304 can be imparted by the circulating pump 306 about the heat pipes 324 in a manner to further enhance absorption of heat by second coolant 314. Further, the number, relative position and/or size of the heat pipes 324 can be varied so as to achieve a particular heat transfer characteristic.

Figure 3A:
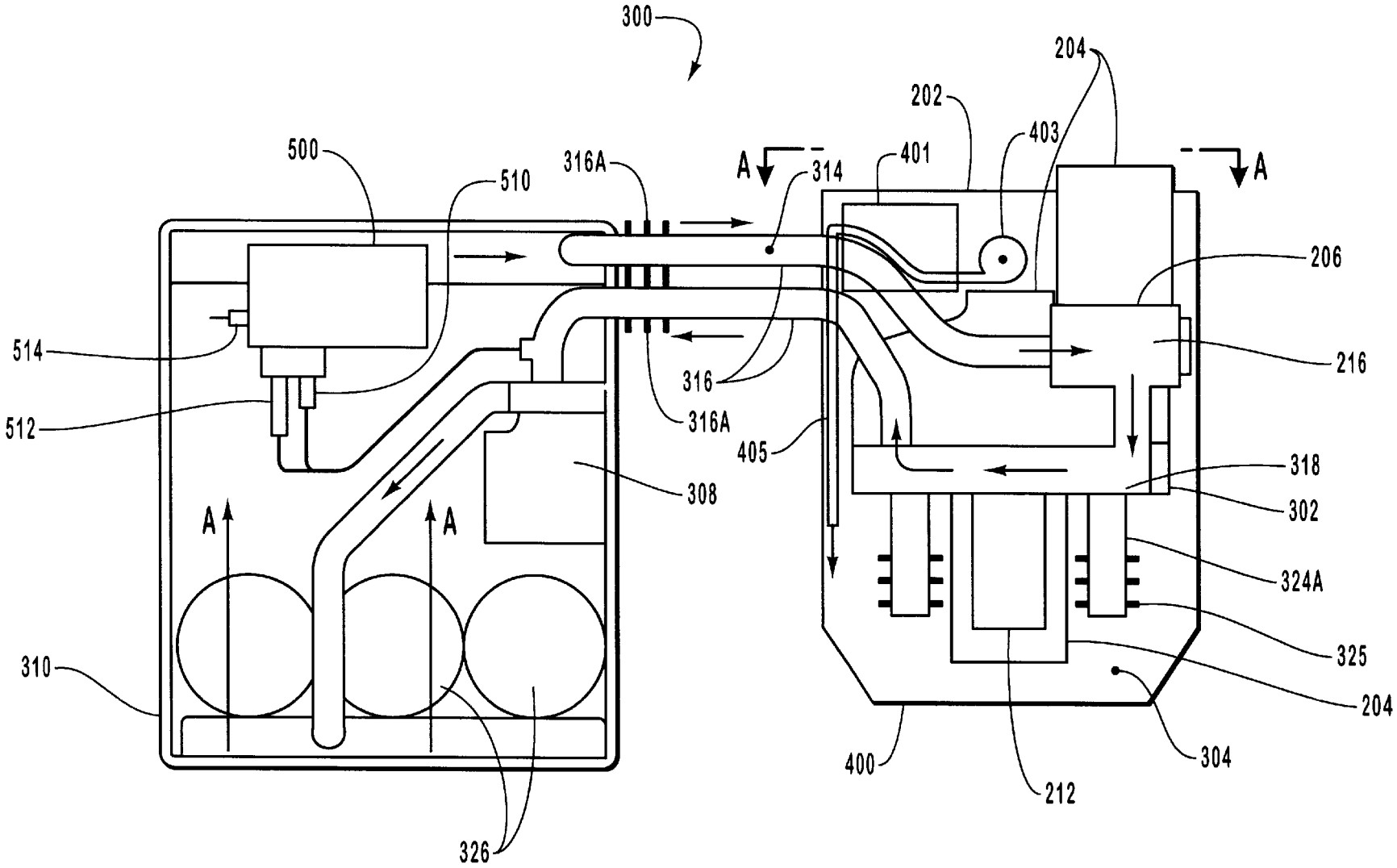
FIG. 3A illustrates another embodiment of a dual fluid cooling system.

For example, FIG. 3A illustrates an alternate structural configuration for augmenting and enhancing the transfer of heat from the first coolant to the second coolant. The heat pipes 325 shown extend into a portion of the first coolant 304, and also provide a fluid communication path for fluid 314 from within the cooling block and cavity 318. Also shown are a plurality of convection fins 324A for enhancing the convective heat transfer from the first fluid 304. Alternatively, or in addition to heat pipes, transfer of heat from the first fluid to the second fluid can be enhanced within the heat pipe via a separate heat transfer mechanism that is positioned within the housing 202 (or external to the housing 202). For example, FIG. 3A shows a fluid-to-fluid heat exchange device 401, through which the first coolant 304 is passed adjacent to the relatively cooler second coolant 314. Preferably, first coolant 304 is forced across a fluid conduit carrying the second coolant 314 with a fluid pump, a similar device, designated at 403. Moreover, the "cooled" first coolant can then be appropriately dispersed at another location (or locations) within the housing 202 via appropriately positioned conduits, such as that designated at 405, so as to provide a desired cooling effect within the housing 202.

Figure 3B:
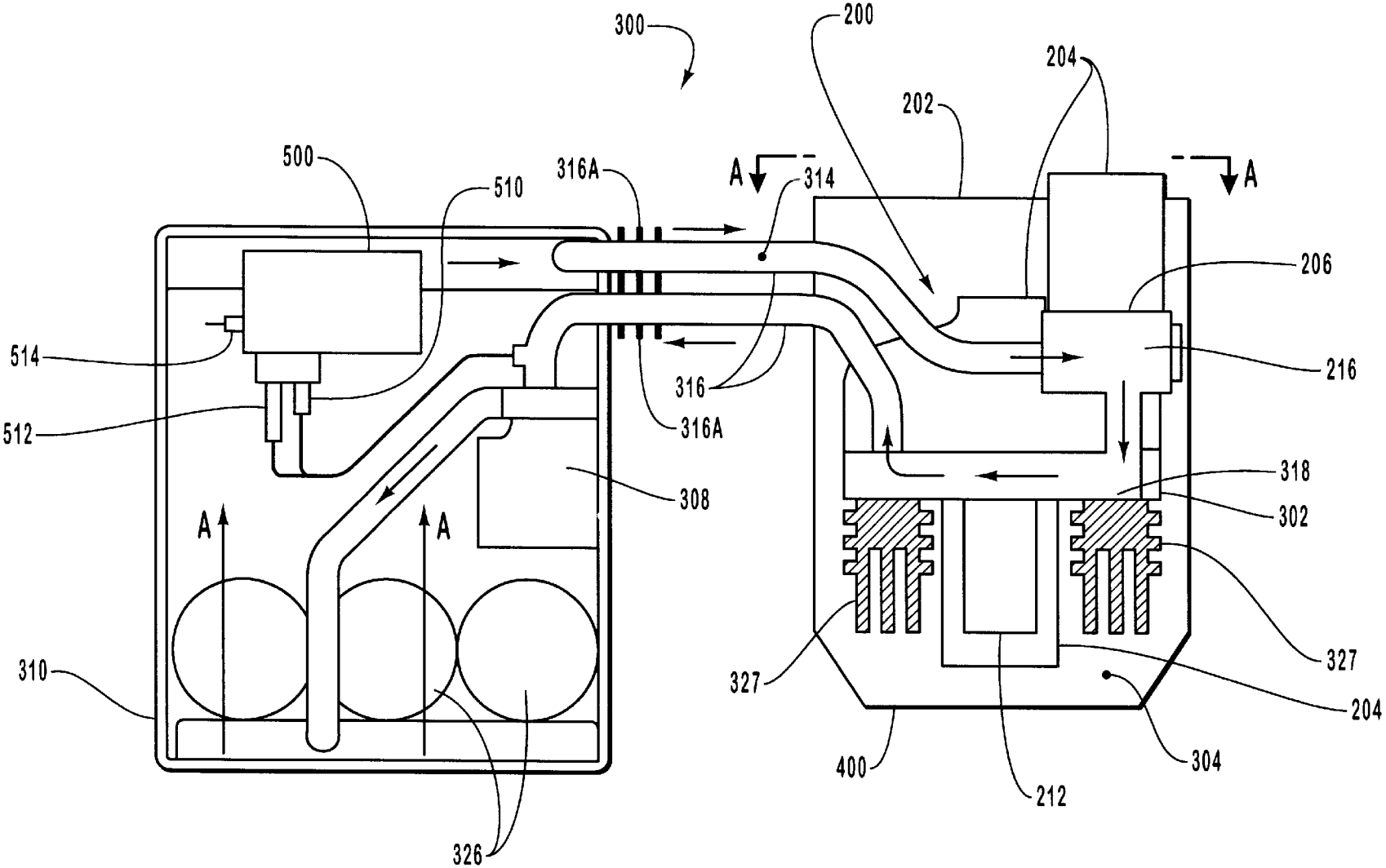
FIG. 3B illustrates yet another embodiment of a dual fluid cooling system.

Yet another alternative structure for providing the function of enhancing the transfer of heat from the first coolant 304 to the second coolant 314 is illustrated in FIG. 3B. In this example, the particular function can be provided by a heat sink structure that is attached to the x-ray tube. For example, a plurality of heat sinks 327 are illustrated in FIG. 3D as being attached directly to the target cooling block 302. The heat sinks 327 are structurally implemented so as to provide the ability to efficiently transfer heat from the first coolant 304 by natural or forced convection. The heat is then conducted directly to the coolant block 302 and to the interior of the target cooling block where the heat can be removed by way of the second coolant 314, again, by way of direct convection. Of course, the exact structural configuration, positioning and number of heat sinks attached to the x-ray tube can be varied depending on the particular heat transfer affects that are desired.

To briefly summarize, the flow of second coolant 314 through fluid passageway 216 of shield structure 206 and fluid passageway 318 of target cooling block 302 effectuates absorption of heat dissipated by x-ray tube 200 in at least two different ways. First, second coolant 314 absorbs heat directly from both the shield structure 216 and the target cooling block 302. Further, second coolant 314, in conjunction with circulating pump 306 and optional heat transfer mechanisms such as fins 322, and heat pipes 324 (or various combinations thereof), absorbs at least some heat from first coolant 304. Upon exiting flow passage 318 of target cooling block 302, second coolant 314 enters fluid conduit 316 and passes to coolant pump 308.

Upon returning to coolant pump 308, second coolant 314 is then discharged by coolant pump 308 into radiator 310. Preferably, radiator 310 comprises a plurality of tubes 326 through which second coolant 314 passes. As suggested in FIG. 3, air, or any other suitable coolant, indicated by flow arrows "A", flowing across tubes 326 serves to absorb heat dissipated by second coolant 314 through the walls of tubes 326. Preferably, coolant flow direction "A" is substantially perpendicular to the longitudinal axes (not shown) of tubes 326, so as to maximize the dissipation of heat by tubes 326.

While the embodiment depicted in FIG. 3 indicates a coolant/air radiator, it will be appreciated that a variety of other structures may be profitably be employed to provide the heat exchange functionality of radiator 310. Accordingly, any structure or device providing the functionality of radiator 310, as disclosed herein, is contemplated as being within the scope of the present invention. Such other structures include, but are not limited to, coolant/water heat exchangers, coolant/refrigerant heat exchangers, and the like. Finally, note that while coolant pump 308 is indicated in FIG. 3 as being mounted to radiator 310, it will be appreciated that coolant pump 308 would function equally well in alternate locations.

Figure 3C:
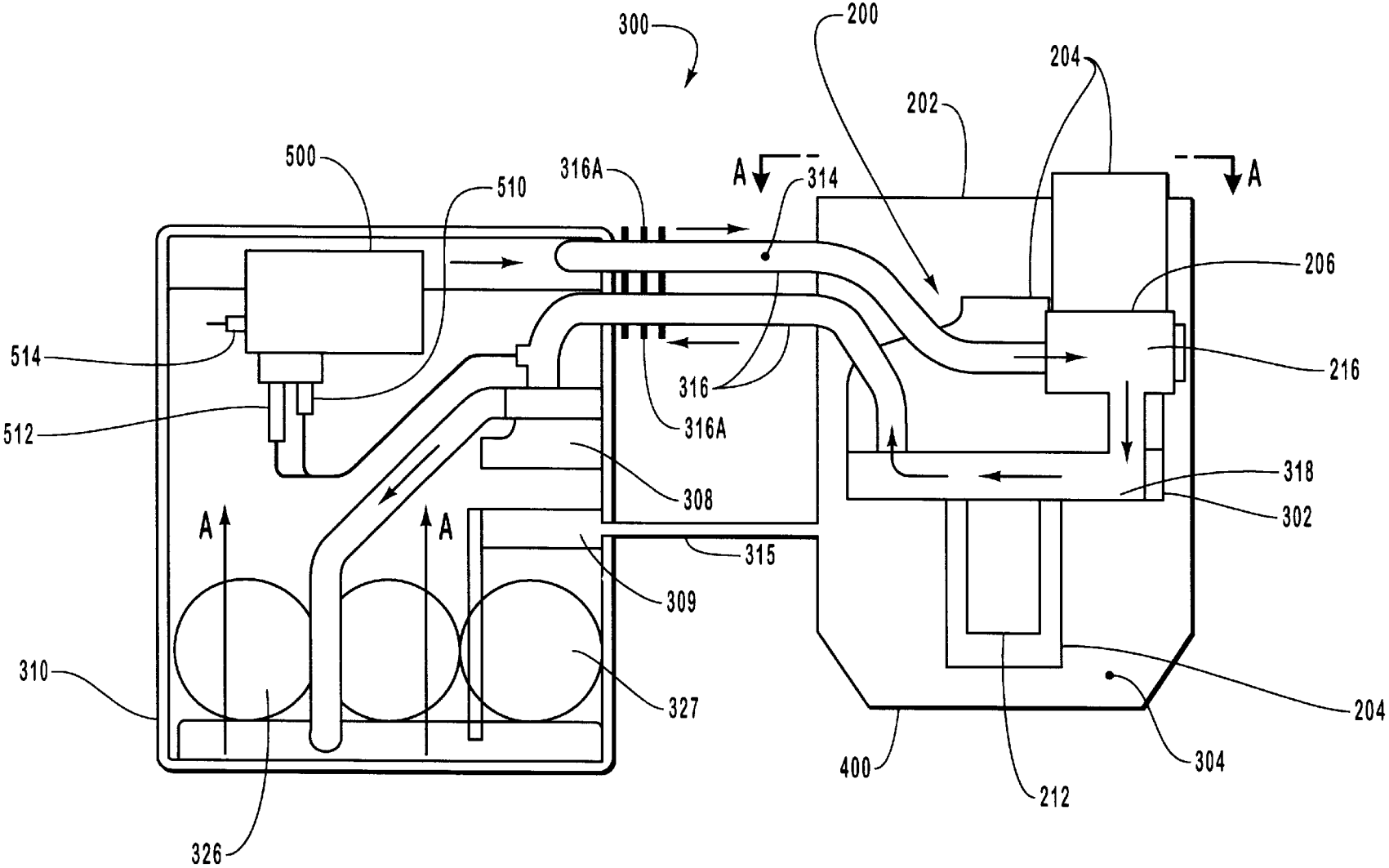
FIG. 3C illustrates another embodiment of a dual fluid cooling system.

It will also be appreciated that while the embodiment depicted in FIG. 3 utilizes a heat exchange mechanism, e.g., radiator 310, for use in connection with the second coolant 314, a similar mechanism functionality can optionally be used in connection with the first coolant 304. For instance, as is generally designated in FIG. 3C, the first coolant 304 disposed in housing 202 can be circulated to a heat exchange device such as a second radiator 327. In this particular embodiment, a fluid conduit 315 is used to transfer the first coolant 304 from the housing 202 to a radiator tube 327 via a second fluid pump 309. As with the second coolant, this arrangement allows for further heat dissipation and heat removal from the first coolant 304, thereby further enhancing the overall efficiency of the coolant system. In this particular arrangement, once the heat is removed from the first coolant 304 by way of the separate heat exchange mechanism, it is routed back into the housing 202 to continue removing heat from the x-ray tube structure. While not illustrated in FIG. 3C, it will also be appreciated that an accumulator structure, or similar pressure regulation means (described in further detail below), could also be used in connection with this arrangement.

Making reference again to FIG. 3, upon passing through radiator 310, second coolant 314 returns to fluid passageway 216 of shield structure 206, via fluid conduit 316, to repeat the cooling cycle. An important factor in the effectiveness and efficiency of second coolant 314 as a heat transfer medium is the pressure of second coolant 314. In general, increasing the pressure on a liquid (such as second coolant 314) confined in a closed system serves to raise the boiling point, and thus the heat absorption capacity, of the liquid. Accordingly, a preferred embodiment of the present invention includes a means for maintaining and regulating the pressure of second coolant 314 at a desired level. It will be appreciated that the pressure of second coolant 314 may be varied as required to achieve a desired cooling effect. By way of example, such a pressure regulating means can be comprised of an accumulator 500 generally represented in FIG. 3.

Figure 5A:
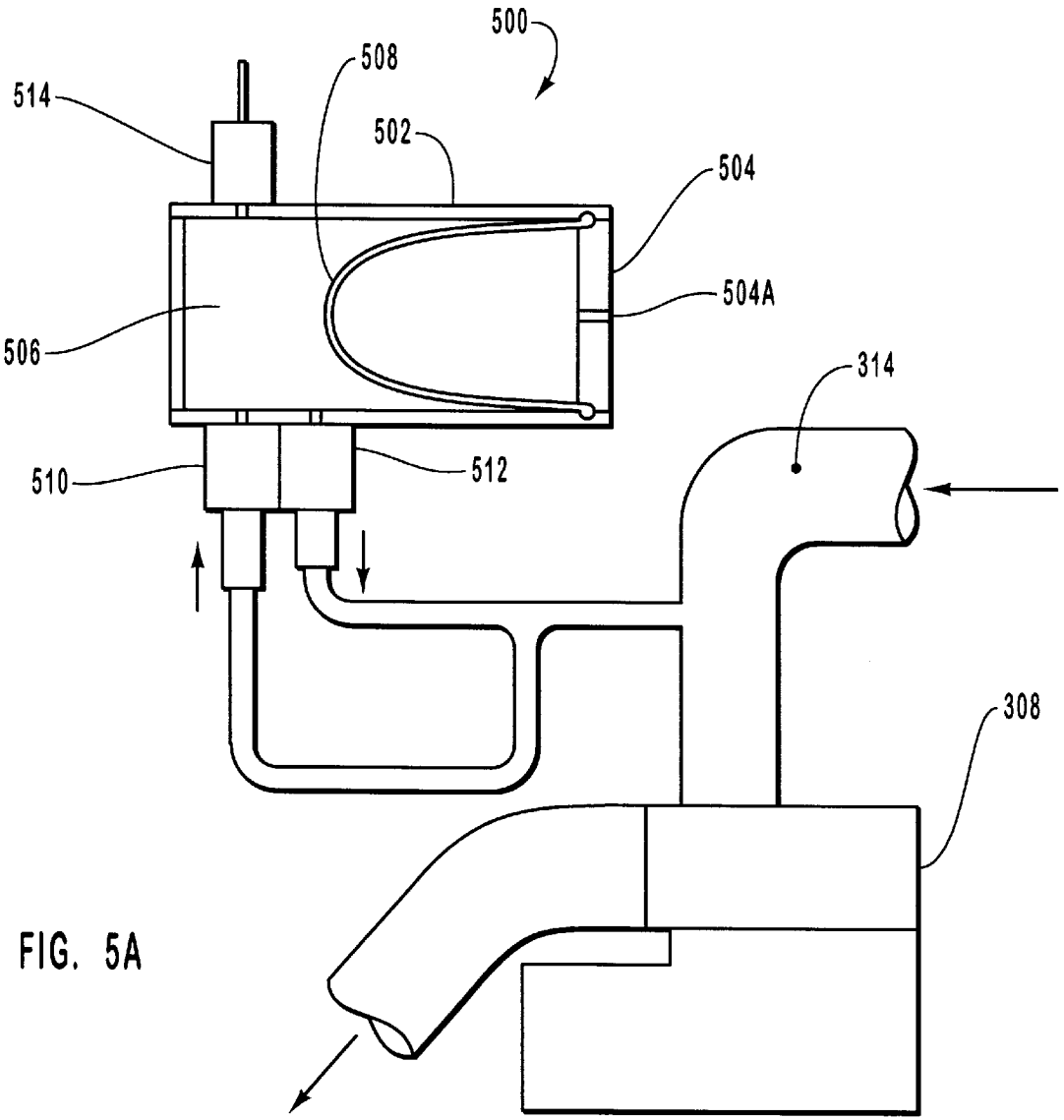
FIG. 5A is a cutaway view of an embodiment of an accumulator, depicting some of the fundamental elements of the accumulator.

Directing attention now to FIG. 5A, additional details regarding the structure and operation of a presently preferred embodiment of the accumulator 500 are provided. Note that any other structure or device providing the functionality of accumulator 500, as disclosed herein, is contemplated as being within the scope of the present invention for providing the pressure regulation function. As indicated in FIG. 5A, accumulator 500 includes an accumulator housing 502, end wall 504, and vent 504A. Disposed within accumulator housing 502 is a diaphragm bellows 508, the edge of which is secured to accumulator housing 502 and end wall 504, thereby defining a chamber 506. A pressure relief valve 510 and check valve 512, preferably mounted to accumulator housing 502, are in fluid communication with chamber 506. As further indicated in FIG. 5A, pressure relief valve 510 and check valve 512 are in fluid communication with the inlet of coolant pump 308. Check valve 512 is oriented so as to permit flow of second coolant 314 only out of chamber 506. Second coolant 314 enters chamber 506, if at all, by way of pressure relief valve 510. Finally, a preferred embodiment of accumulator 500 comprises a safety valve 514 in fluid communication with chamber 506.

Following is a general description of the operation of accumulator 500. As second coolant 314 circulates and absorbs heat from x-ray tube 200 and first coolant 304, the pressure and temperature of second coolant 314 increases. When the pressure of second coolant 314 reaches a set pressure, preferably about 25 pounds per square inch—gage (psig), pressure relief valve 510 opens and admits an amount of second coolant 314 into accumulation chamber 506 of accumulator 500. As the volume of second coolant 314 continues to increase, in response to continued absorption of heat dissipated by x-ray tube 200, second coolant 314 continues to enter chamber 506 through relief valve 510, gradually forcing diaphragm bellows 508 towards end wall 504.

It is accordingly a valuable feature of accumulator 500 that it accommodates volumetric changes in second coolant 314 resulting from absorption of heat dissipated by x-ray tube 200. Note that because vent 504A of end wall 504 is open to the atmosphere, diaphragm bellows 508 is free to move back and forth, with respect to end wall 504, in response to changing pressure in second coolant 314.

Other valuable features of accumulator 500 relate to the construction and material of diaphragm bellows 508. As suggested above, diaphragm bellows 508 deforms in response to pressure exerted by expanding second coolant 314 disposed in chamber 506. In particular, diaphragm bellows 508 is preferably constructed of a material that, while deformable, is also sufficiently resilient that diaphragm bellows 508 deforms only to the extent necessary to accommodate the expansion of second coolant 314. That is, the resilient nature of diaphragm bellows 508 causes it to exert a responsive counter force that is proportional to the force exerted on diaphragm bellows 508 as a result of the expansion of second coolant 314. In this way, diaphragm bellows 508 accommodates volumetric changes in second coolant 314 while simultaneously maintaining a desired system pressure.

Not only does accumulator 500 serve to maintain a desired system pressure when second coolant 314 is expanding as a result of heat absorption, but accumulator 500 also provides an analogous functionality in those instances where second coolant 314 is allowed to cool, such as might occur between x-ray exposures. In particular, the pressure of second coolant 314 outside chamber 506 eventually drops below the set pressure of relief valve 510 and relief valve 510 closes. At this point then, the pressure in chamber 506 is higher than the system pressure because second coolant 314 is admitted to chamber 506 only when its pressure is high enough to open relief valve 510, preferably about 20 psig. Consequently, second coolant 314 flows out of accumulator chamber 506 via check valve 512 and, preferably, into the suction line of coolant pump 508 until there is no longer a pressure differential between the system and chamber 506, whereupon check valve 512 closes. Thus, accumulator 500 serves to maintain system pressure at a desired level, even when second coolant 314 is allowed to cool.

Finally, in an overheat situation, such as might occur when x-ray device 100 is left in the exposure mode for too long, the pressure of second coolant 314 could build to an unsafe level. In such situations, excess system pressure is vented from chamber 506 via safety valve 514. Safety valve 514 preferably comprises a pressure relief valve or the like. However, any other valve or device that would provide the functionality of safety valve 514, as disclosed herein, is contemplated as being within the scope of the present invention. Preferably, safety valve 514 opens at a set pressure level and vents excess system pressure inside radiator 310. This safety feature of accumulator 500 is particularly valuable because a leak of second coolant 314 inside cooling system 300 would likely cause catastrophic damage to x-ray device 100 and may also endanger the safety of operating personnel and others.

In a preferred embodiment, diaphragm bellows 508 preferably comprises a semi-rigid rubber, or the like. However, any other material providing the functionality of diaphragm bellows 508, as disclosed herein, is contemplated as being within the scope of the present invention. Further, the functionality of diaphragm bellows 508 may be profitably supplied by a variety of alternative structures. Note however, that any structure or device providing the functionality of diaphragm bellows 508, as disclosed herein, is contemplated as being within the scope of the present invention. Embodiments of two alternative structures, indicated in FIGS. 5B and 5C, respectively, are discussed below.

Figure 5C:
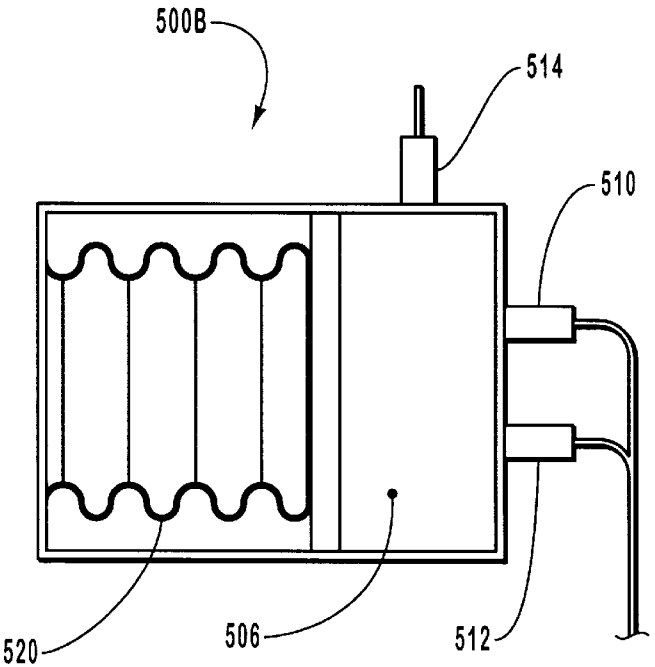
FIG. 5C is a cutaway view of a second alternative embodiment of an accumulator.
Figure 5B:
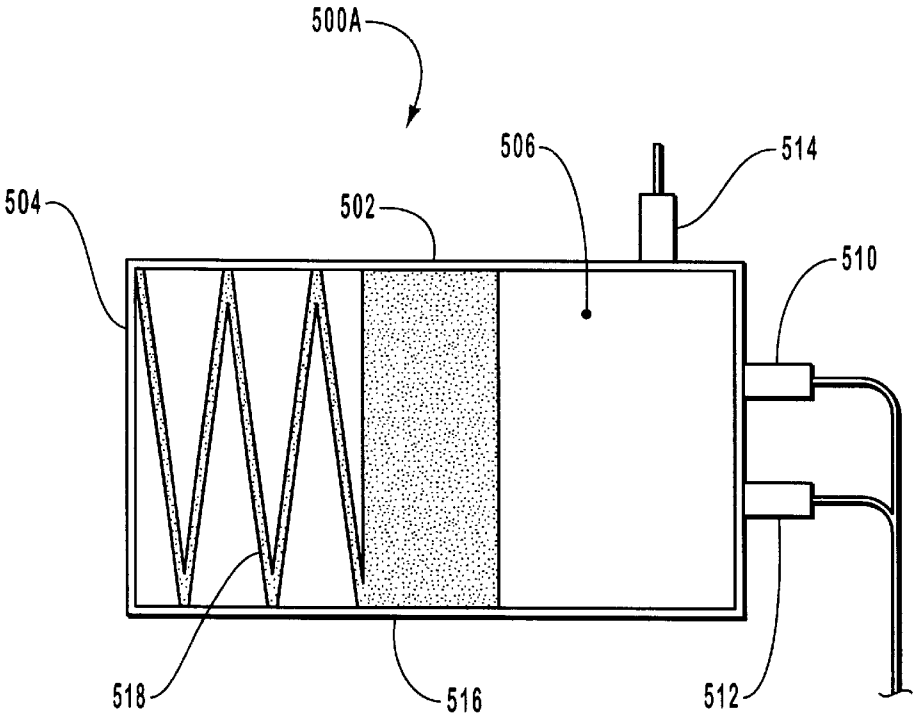
FIG. 5B is a cutaway view of a first alternative embodiment of an accumulator.

Directing attention first to FIG. 5B, various construction details of an accumulator 500A are indicated. In addition to accumulator housing 502, end wall 504, chamber 506, pressure relief valve 510, check valve 512, and safety valve 514, accumulator 500A further preferably comprises a piston 516 bearing against a spring 518. End wall 504 prevents movement, other than compression, of spring 518. The theory of operation of accumulator 500A is substantially the same as described above for accumulator 500. In the case of the embodiment depicted in FIG. 5B, however, when system pressure is admitted to chamber 506 via pressure relief valve 510, the system pressure is exerted against piston 516. Movement of piston 516 is resisted by spring 518, so that as the pressure on piston 516 increases, spring 518 exerts a proportional force in opposition thereto. In this way, spring 518 thus serves to maintain a desired level of pressure in coolant system 300. As discussed elsewhere herein, pressure exerted on second coolant 314 has the desirable effect of increasing the boiling point of second coolant 314 and thereby increases its heat absorption capacity. Further, the resilience of spring 518 allows accumulator 500A to respond to cooling of second coolant 314 in substantially the same manner as that described in the discussion of diaphragm bellows 508 above. Finally, it will be appreciated that by employing springs having different characteristic spring constants "k", the pressure exerted on second coolant 314, and thus the boiling point and heat absorption capacity of second coolant 314, may be varied as required to achieve a desired cooling effect.

Alternatively, piston 516 and spring 518 may be replaced with a bellows 520 or the like, as indicated in the embodiment depicted in FIG. 5C. Preferably, bellows 520 comprises a semi-rigid metallic material having a predetermined spring constant so as to enable it to exert a desired force on second coolant 314. By virtue of its semi-rigidity, bellows 520 thus incorporates features of both piston 516 and spring 518 of accumulator 500A. In particular, as second coolant 314 enters accumulation chamber 506 via relief valve 512, the pressure of second coolant 314 is exerted on metallic bellows 520 which then exerts a proportional force on second coolant 314 in response thereto. As discussed elsewhere herein, pressure exerted on second coolant 314 has the desirable effect of increasing the boiling point of second coolant 314 and thereby increases its heat absorption capacity. Further, the resilience of bellows 520 allows accumulator 500B to respond to cooling of second coolant 314 in substantially the same manner as that described in the discussion of diaphragm bellows 508 above.

Note that any other structure or device providing the functionality of bellows 520, as disclosed herein, is contemplated as being within the scope of the present invention. Finally, it will be appreciated that by employing bellows 520 having different characteristic spring constants "k", the pressure exerted on second coolant 314, and thus the boiling point and heat absorption capacity of second coolant 314, may be varied as required to achieve a desired cooling effect.

In summary then, cooling system 300 thus comprises a number of valuable features. For at least the reasons set forth below, these features represent an advancement in the relevant art, and serve to render cooling system 300 particularly well-suited for application in high-power x-ray device environments.

In particular, and as discussed elsewhere herein, second coolant 314 preferably comprises a water/propylene glycol solution. Such water-based solutions have a high specific heat, typically about 0.90 to 0.98 BTU/lb-° F., which enables them to absorb relatively more heat than solutions with lower specific heat values. The heat absorption capacity of second coolant 314 is further enhanced by the glycol component of second coolant 314 which causes a relative increase in the boiling point of second coolant 314. Thus, the relatively higher specific heat and boiling point of second coolant 314, in combination with the desirable effects of the coolant pressurization provided by accumulator 500, results in a substantial relative increase in the heat absorption capacity of cooling system 300 over known cooling systems, and accordingly makes cooling system 300 particularly well-suited for use with high-power x-ray devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray device, comprising:

(a) an x-ray tube substantially disposed within a housing; and (b) a cooling system, the cooling system including;

(i) a first coolant disposed in the housing so that at least a portion of heat dissipated by the x-ray tube is absorbed by the first coolant; and (ii) at least one fluid passageway capable of directing a flow of a second coolant proximate to at least a portion of the x-ray tube so that at least a portion of heat dissipated by the x-ray tube is absorbed by the second coolant.

2. The x-ray device as recited in claim 1, wherein said at least one fluid passageway carrying the second coolant is at least partially defined in a shield structure disposed between a target anode and an electron source of said x-ray tube.

3. The x-ray device as recited in claim 1, wherein said at least one fluid passageway is at least partially defined within a target cooling block that is positioned at a point that is substantially adjacent to a target anode of the x-ray tube.

4. The x-ray device as recited in claim 1, wherein said first coolant comprises a dielectric fluid.

5. The x-ray device as recited in claim 1, wherein said second coolant comprises water and alcohol.

6. The x-ray device as recited in claim 1, wherein said second coolant is pressurized.

7. The x-ray device as recited in claim 1, wherein the at least one fluid passageway is substantially proximate to at least a portion of the first coolant in a manner so that at least some heat is transferred from the first coolant to the second coolant.

8. The x-ray device as recited in claim 1, further comprising a circulating pump, said circulating pump imparting motion to said first coolant disposed in said housing so as to facilitate forced convective cooling of at least a portion of said x-ray tube.

9. The x-ray device as recited in claim 1, further comprising a heat transfer mechanism disposed proximate to the second coolant in a manner so as to permit at least a portion of the heat within the first coolant to be transferred to the second coolant.

10. The x-ray device as recited in claim 9, wherein the heat transfer mechanism is comprised of a plurality of fins.

11. The x-ray device as defined in claim 9, wherein the heat transfer mechanism is comprised of at least one heat pipe having at least one fluid conduit in fluid communication with the fluid passageway.

12. The x-ray device as defined in claim 10, wherein the plurality of fins are at least partially disposed on a target cooling block, the target cooling block being positioned proximate to a target anode of the x-ray tube.

13. A cooling system for an x-ray tube that is substantially disposed within a housing and that has a target anode having a target surface positioned to receive electrons from an electron source, the cooling system comprising:

(a) a first coolant disposed in the housing so that at least some heat dissipated by the x-ray tube is absorbed by said first coolant;

(b) at least one first fluid passageway defined by a shield structure that has an aperture through which the electrons are passed from the electron source to the target surface;

(c) at least one second fluid passageway defined by a target cooling block that is disposed proximate to the target anode so as to absorb at least some heat dissipated by the target anode; and (d) at least one pump, said at least one pump circulating a second coolant through said at least one first and second fluid passageways.

14. The cooling system as recited in claim 13, wherein said first coolant is circulated throughout the housing by a circulating pump.

15. The cooling system as recited in claim 13, wherein said at least one first fluid passageway at least partially is proximate to said first coolant so that at least some heat dissipate by said first coolant is absorbed by said second coolant.

16. The cooling system as recited in claim 13 further comprising a heat transfer mechanism that is positioned proximate to the first coolant so as to increase the rate of heat transfer from said first coolant to said second coolant.

17. The cooling system as recited in claim 16, wherein said heat transfer mechanism comprises a plurality of fins.

18. The cooling system as recited in claim 13, wherein said second coolant is pressurized within a predefined pressure range.

19. The cooling system as recited in claim 13, further comprising an accumulator in fluid communication with the second coolant so as to accommodate volumetric changes in said second coolant due to temperature changes in said second coolant.

20. The cooling system as recited in claim 13, further comprising an accumulator in fluid communication with the second coolant so as to maintain the pressure of the second coolant within a predefined range.

21. The cooling system as recited in claim 13, further comprising a radiator placed in fluid communication with the second coolant, whereby at least some heat is removed from the second coolant.

22. The cooling system as recited in claim 13, further comprising a radiator in fluid communication with the first coolant so as to remove at least some heat from the first coolant.

23. The cooling system as recited in claim 13, further comprising a safety relief valve having a predetermined set point so that said relief valve opens when pressure of said second coolant exceeds said set point.

24. The cooling system as recited in claim 13, wherein said target cooling block further comprises at least one fluid passageway capable of directing a flow of said first coolant proximate to at least a portion of the at least one second fluid passageway so that said second coolant absorbs at least some heat dissipated by said first coolant.

25. The cooling system as recited in claim 13, wherein said first coolant comprises a dielectric fluid.

26. The cooling system as recited in claim 13, wherein said second coolant comprises at least water and alcohol.

27. In an x-ray tube substantially disposed within a housing, a method for cooling the x-ray tube, comprising the steps of:

(a) placing a first coolant in the housing, the first coolant being in contact with at least a portion of the x-ray tube so that said first coolant absorbs at least some heat dissipated by the x-ray tube;

(b) circulating a second coolant through a fluid passageway that is substantially proximate to at least a portion of the x-ray tube so that said second coolant absorbs at least some heat dissipated by the x-ray tube; and (c) continuously removing at least some heat from said second coolant.

28. The method as recited in claim 27, wherein the second coolant is passed through a portion of the fluid passageway formed in a shield structure of the x-ray tube.

29. The method as recited in claim 27, wherein the second coolant is passed through a portion of the fluid passageway formed in a target cooling block of the x-ray tube.

30. The method as recited in claim 27, further comprising the step of regulating the pressure of the second coolant within a predetermined range.

31. The method as recited in claim 27, further comprising the step of imparting motion to at least a portion of said first coolant.

32. The method as recited in claim 27, further comprising the step of storing at least a portion of a volumetric increase of said second coolant experienced as a result of heat absorption by said second coolant.

33. The method as recited in claim 27, further comprising the step of routing at least a portion of said second coolant to a point proximate to at least a portion of said first coolant so that said second coolant absorbs at least some heat dissipated by said first coolant.

34. An x-ray device, comprising:

(a) an x-ray tube substantially disposed within a housing; and (b) a cooling system, the cooling system including:

(i) a first coolant disposed in the housing so that at least a portion of heat dissipated by the x-ray tube is absorbed by the first coolant; and (ii) at least one fluid passageway capable of directing a flow of a second coolant proximate to at least a portion of the x-ray tube so that at least a portion of heat dissipated by the x-ray tube is absorbed by the second coolant, the at least one fluid passageway being at least partially defined in a shield structure disposed between a target anode and an electron source of said x-ray tube.

35. The x-ray device as recited in claim 34, wherein said at least one fluid passageway is at least partially defined within a target cooling block that is positioned at a point that is substantially adjacent to a target anode of the x-ray tube.

36. The x-ray device as recited in claim 34, wherein said first coolant comprises a dielectric fluid.

37. The x-ray device as recited in claim 34, wherein said second coolant comprises water and alcohol.

38. The x-ray device as recited in claim 34, wherein said second coolant is pressurized.

39. The x-ray device as recited in claim 34, wherein the at least one fluid passageway is substantially proximate to at least a portion of the first coolant in a manner so that at least some heat is transferred from the first coolant to the second coolant.

40. The x-ray device as recited in claim 34, further comprising a circulating pump, said circulating pump imparting motion to said first coolant disposed in said housing so as to facilitate forced convective cooling of at least a portion of said x-ray tube.

41. The x-ray device as recited in claim 34, further comprising a heat transfer mechanism disposed proximate to the second coolant in a manner so as to permit at least a portion of the heat within the first coolant to be transferred to the second coolant.

42. The x-ray device as recited in claim 41, wherein the heat transfer mechanism is comprised of a plurality of fins.

43. The x-ray device as defined in claim 41, wherein the heat transfer mechanism is comprised of at least one heat pipe having at least one fluid conduit in fluid communication with the fluid passageway.

44. The x-ray device as defined in claim 42, wherein the plurality of fins are at least partially disposed on a target cooling block, the target cooling block being positioned proximate to a target anode of the x-ray tube.

* * * * *

UNITED STATES PATENT AND TRADEMARK OFFICE

CERTIFICATE OF CORRECTION

PATENT NO. : 6,519,317 B2
APPLICATION NO. : 09/829353
DATED : February 11, 2003
INVENTOR(S) : Richardson et al.

It is certified that error appears in the above-identified patent and that said Letters Patent is hereby corrected as shown below:

Title page, under Item [56] "References Cited"; after "5,541,975 A" change "7/1996" to --6/1996--

Title page, under Item [57] "ABSTRACT", line 5; before "The cooling system" insert --To improve heat absorption from the stator and the x-ray tube, the dielectric coolant is circulated throughout the housing by a circulating pump.--

Col. 1, line 33; before "accelerate" insert --to--

Col. 12, line 7; after "profitably" remove [be]

Col. 16, line 57; change "dissipate" to --dissipated--

Signed and Sealed this

Twenty-first Day of December, 2010

David J. Kappos

David J. Kappos
*Director of the United States Patent and Trademark Office*